US007211009B2

(12) United States Patent
Samaras et al.

(10) Patent No.: US 7,211,009 B2
(45) Date of Patent: May 1, 2007

(54) LACROSSE HEAD NETTING WITH A SHALLOW POCKET

(75) Inventors: Crista Samaras, New York, NY (US); Jesse Hubbard, New York, NY (US); Andrew Maliszewski, Dearborn Heights, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 10/437,535

(22) Filed: May 14, 2003

(65) Prior Publication Data

US 2004/0229718 A1 Nov. 18, 2004

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/505, 512, 528, 543, 514, 515; D21/724
See application file for complete search history.

(56) References Cited

U.S. PATENT DOCUMENTS 2,039,138 A * 4/1936 Auer ..... 473/513
3,507,495 A * 4/1970 Roland et al. ..... 473/513
4,938,480 A * 7/1990 Lods ..... 473/513
6,213,901 B1 * 4/2001 Collinson ..... 473/513
2003/0162612 A1 * 8/2003 O'Banion et al. ..... 473/513

OTHER PUBLICATIONS

Internet Page,E-Lacrosse Shooting Strings, Apr. 17, 2001,www.e-lacrosse.com/stech24.html,9 pages.*

* cited by examiner

*Primary Examiner*—Eugene Kim
*Assistant Examiner*—M. Chambers
(74) *Attorney, Agent, or Firm*—John S. Artz, Esq.; Artz & Artz, PC

(57) ABSTRACT

A lacrosse head having a netting with a shallow pocket is provided for improving the handling and the retention of a lacrosse ball. The lacrosse head includes a frame element comprised of a pair of opposing sidewalls that each have a top end and a bottom end, a scoop portion connecting the top ends of the sidewalls, and a base portion connecting the bottom ends of the sidewalls. Furthermore, the lacrosse head includes a netting that is coupled to the opposing sidewalls. This netting has one or more partitions coupled thereto for substantially defining a ball retention region and one or more peripheral regions of the netting. These partitions protrude outwardly from the netting and are adapted for contacting a lacrosse ball and retaining the lacrosse ball within the ball retention region.

16 Claims, 7 Drawing Sheets

LACROSSE HEAD NETTING WITH A SHALLOW POCKET

TECHNICAL FIELD

The present invention relates generally to a netting for a lacrosse head, and more particularly to a netting for a lacrosse head having a shallow pocket for providing quick release, improved control, and enhanced retention of a lacrosse ball.

BACKGROUND

A variety of different types of netting exist for attachment to lacrosse sticks. With regard to netting style, the two most common types of nettings are mesh and traditional. Additionally, with regard to pocket depth, one common type of netting includes a pocket having a shallow depth. Other types of netting have pockets with a larger depth or moderate depth.

While pockets having a relatively large depth are common, nettings with shallow pockets are useful in that they typically allow for the quick release of lacrosse balls from the lacrosse head. The quick release of lacrosse balls is beneficial because it can allow a lacrosse player to pass and shoot the lacrosse ball with greater speed to exploit an unattended goal or an unguarded teammate, as well as to avoid an oncoming defender.

Lacrosse players who desire the quick release of lacrosse balls can attach the netting to their lacrosse head in a manner that creates a shallow pocket. In addition, women lacrosse players typically are required by the lacrosse regulations to string their pockets with a shallow depth to prevent the ball from resting too low in the lacrosse head.

A drawback of these shallow pockets is that their structure can cause the lacrosse head to have insufficient ball control and inadequate ball retention. Specifically, the shallow pocket does not allow the lacrosse ball to rest deeply within the lacrosse head. Accordingly, these shallow pockets typically allow the lacrosse ball to freely move across the entire netting of the pocket, i.e. from one side of the lacrosse head to the other side. This unfettered movement permits the lacrosse ball to roll toward a sidewall of the lacrosse head, bounce off the sidewall, and then exit the lacrosse head. This is particularly prevalent, if the lacrosse head is being checked by another player. Alternatively, the lacrosse ball may freely roll toward the scoop of the lacrosse head and out of the lacrosse head while a player is running with or cradling the lacrosse ball. For these reasons, the lacrosse ball can be easily knocked out of or dropped from a lacrosse head strung with netting having a shallow pocket.

It is therefore desirable to provide a netting for a lacrosse head having a shallow pocket that provides improved ball control and enhanced retention of a lacrosse ball.

SUMMARY OF THE INVENTION

The present invention provides a lacrosse head having a netting with a shallow pocket that provides improved handling and retention of a lacrosse ball. The lacrosse head includes a frame element comprised of a pair of opposing sidewalls that each have a top end and a bottom end, a scoop portion connecting the top ends of the sidewalls, and a base portion connecting the bottom ends of the sidewalls. Furthermore, the lacrosse head includes a netting that is coupled to the opposing sidewalls. This netting has one or more partitions or retaining structures coupled thereto for substantially defining a ball retention region. These partitions protrude outwardly or upwardly from the netting to contact a lacrosse ball and provide some ability to retain the lacrosse ball within the ball retention region.

One advantage of the present invention is to provide a netting for a lacrosse head that allows a player to quickly pass and/or shoot a lacrosse ball.

It is a related advantage of the present invention to provide a netting with a shallow pocket for a lacrosse head that allows a player to quickly pass and/or or shoot a lacrosse ball.

Another advantage of the present invention is to provide a netting for a lacrosse head with improved ball control and ball retention that minimizes lacrosse ball rattling within the lacrosse head and/or dislodging or dropping therefrom.

It is a related advantage of the present invention to provide a netting with a shallow pocket for a lacrosse head with improved ball contact and ball retention that minimizes lacrosse ball rattling within the lacrosse head and/or dislodging or dropping therefrom.

Other advantages of the present invention will become apparent upon considering the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
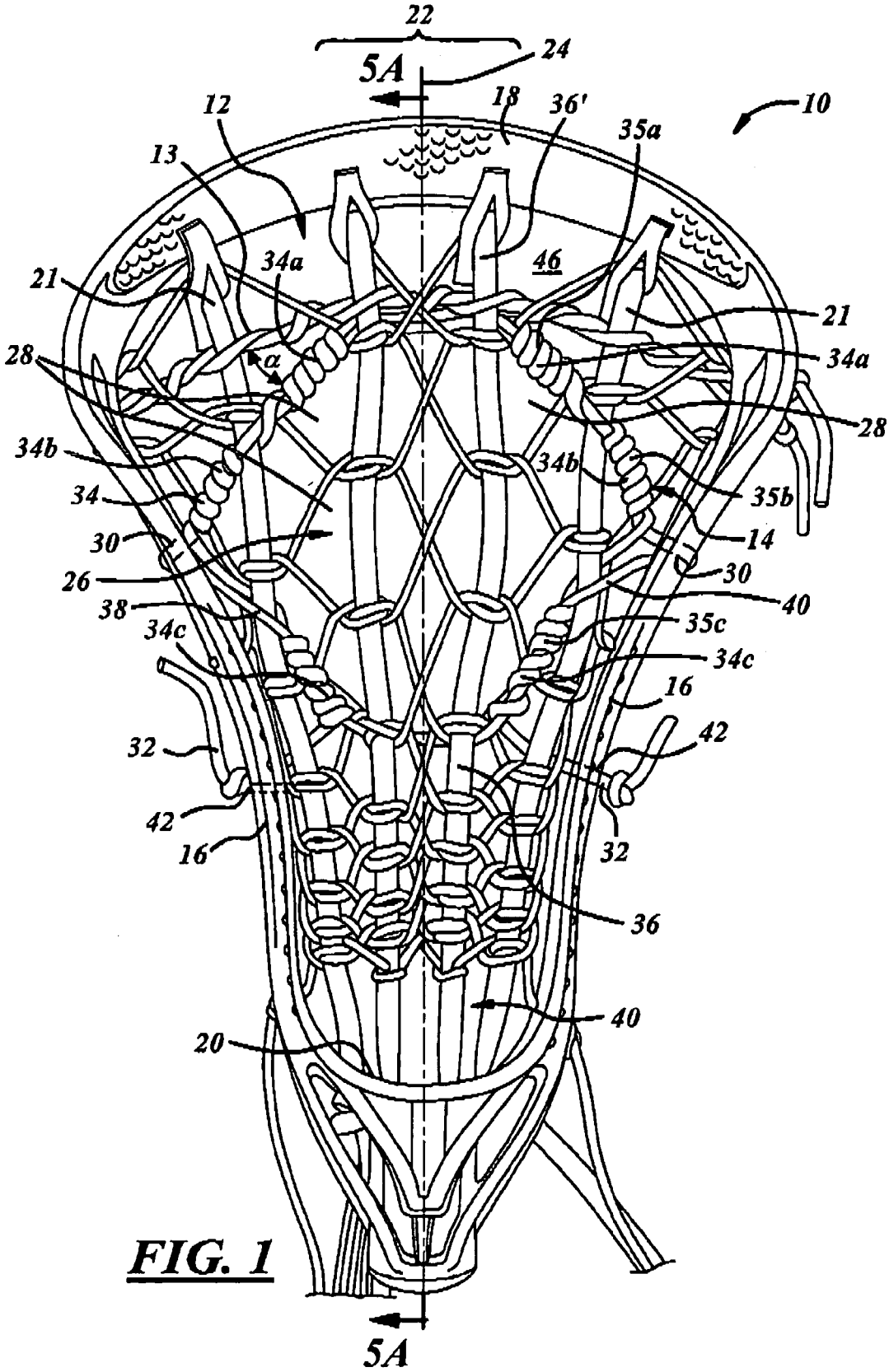
FIG. 1 is a front view of a lacrosse head having a netting with a shallow pocket and one or more retention structures formed on the netting, in accordance with one embodiment of the present invention.

In the following figures, the same reference numerals will be used to illustrate the same components in the various views. The present invention is particularly suited to lacrosse heads having nettings with shallow pockets. However, it is understood that the present invention can also be suited for lacrosse heads having nettings with a variety of pocket depths, e.g. non-shallow or deep pockets.

Referring now to FIG. 1, there is shown a front view of a lacrosse head 10 having a netting 12 with a shallow pocket and a retaining structure 14 coupled to the netting 12, according to one embodiment of the present invention. What constitutes a shallow pocket will be understood by one of skill in the art, but generally includes a pocket where the majority of the lacrosse ball remains above the lower rim of the sidewalls when the ball is positioned in the head. The lacrosse head 10 includes a frame element comprised of a pair of opposing sidewalls 16, a scoop portion 18 extending between and connecting the top ends of the sidewalls 16, and a base portion 20 extending between and connecting the bottom ends of the sidewalls 16. This lacrosse head 10 preferably is comprised of a plastic material and formed by injection molding processes. Of course, it is understood that the lacrosse head 10 may be constructed from other materials and from other suitable manufacturing processes as desired.

Figure 2:
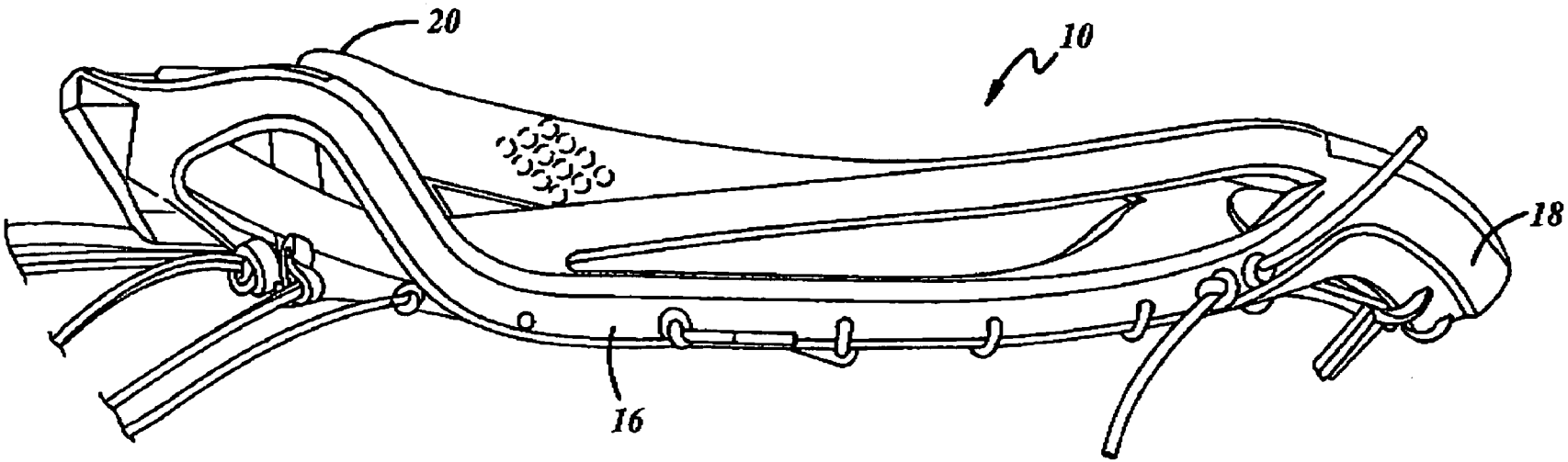
FIG. 2 is a side view of the lacrosse head shown in FIG. 1.

The netting 12 shown in the embodiment of FIG. 2 is a traditional netting having a shallow pocket depth that extends between and is supported by the sidewalls 16, the scoop portion 18, and the base portion 20. This netting 12 includes a plurality of leather thongs 21 that extend and are attached thereto in a conventional fashion generally between the scoop 18 and the base 20 and a plurality of nylon straps 23 that extend between the opposing sidewalls and are interlaced with the thongs 21. As is known, the netting 12 is intended to retain the lacrosse ball within the lacrosse head 10. In another embodiment, the netting can be comprised of other suitable materials, e.g. nylon, polyester, and cotton, and can be attached to the lacrosse head in a variety of other suitable ways. Moreover, it is understood that the netting 12 may consist of a mesh pocket instead of a traditional pocket as desired.

The netting 12 includes a shooting portion, which is generally indicated by reference number 22, and in one embodiment consists of a plurality of thongs 21. The shooting portion 22 extends substantially across the length of the netting 12 through the ball retention region 26. In the embodiment shown in FIG. 1, the shooting portion 22 extends across the entire length of the netting 12 and is located generally adjacent a centerline 24 of the lacrosse head 10. This shooting strip portion 22 allows a lacrosse ball to freely roll across the netting 12 thereby permitting a player to move the ball from the base 20 to the scoop 18 where it can be passed or shot without causing the lacrosse ball to contact or be otherwise impeded by one or more partitions formed on the netting 12 (as discussed in detail in the descriptions for FIGS. 3A–3E and 4–6). In another embodiment, the partitions discussed below can be located in the shooting portion, but may be configured in a manner to provide a lesser impediment to a ball exiting the head, such as by making them smaller.

The shallow pocket of the netting 12 allows for the quick release of the lacrosse ball, as well as for long distance throws. An example of a shallow pocket is generally illustrated in FIG. 2. Fast break lacrosse players typically adjust their pocket depth accordingly to enable these results. Additionally, it is known in the art that women's lacrosse heads also typically have nettings with shallow pocket depth, as is regulated by game regulations. However, it is understood that other players may desire or require lacrosse heads having pockets of shallow depth for a variety of different reasons and preferences including style of play.

In accordance with the present invention, the netting 12 generally includes one or more partitions or retention structures attached or otherwise coupled thereto which generally form a ball retention region 26. The partitions also create one or more peripheral regions 46 in the netting around the ball retention region 26. These partitions are adapted for contacting the lacrosse ball and retaining the lacrosse ball within the ball retention region 26. As a result, the partitions can prevent the lacrosse ball from rolling across the netting, bouncing off the sidewalls 16, and thus inadvertently exiting or being dislodged from the lacrosse head 10. For this reason, the partitions can enhance ball control and ball retention within the lacrosse head 10.

In one embodiment shown in FIG. 1, the ball retention region 26 has a generally diamond shape comprised of an upper area and center area of the netting 12. The upper area and the center area of the netting 12 includes a plurality of openings 28 of the netting 12. However, it is understood that the center area can include any number of openings as desired. In addition, the ball retention region 26 can be located at other areas of the netting 12 and can take on a variety of alternate shapes, including circular or oval.

Specifically, in one embodiment (as shown in FIGS. 1, 2, and 3A–3E), the partition is a retaining structure 14 comprised of a stringing detent or retention surface 14 woven through the netting 12 and one or more holes 30 formed within the sidewalls 16 of the lacrosse head 10. In one embodiment, this stringing detent 14 is a single length of lacing 32 having one or more coiled sections 34, which are raised with respect to the surrounding netting. These raised coiled sections 34 will contact the lacrosse ball and assist in retaining the lacrosse ball within the ball retention region 26. This lacing 32 preferably is comprised of a nylon material. However, it is understood that the lacing can instead be comprised of other suitable materials, e.g. polyester and cotton, as desired. Moreover, the lacing may also be formed of a polymer material.

Referring now to FIGS. 3A–3E, there generally is illustrated a method for attaching the stringing detent 14 (shown in FIG. 1) to the netting 12 in accordance with one embodiment of the present invention.

Figure 3B:
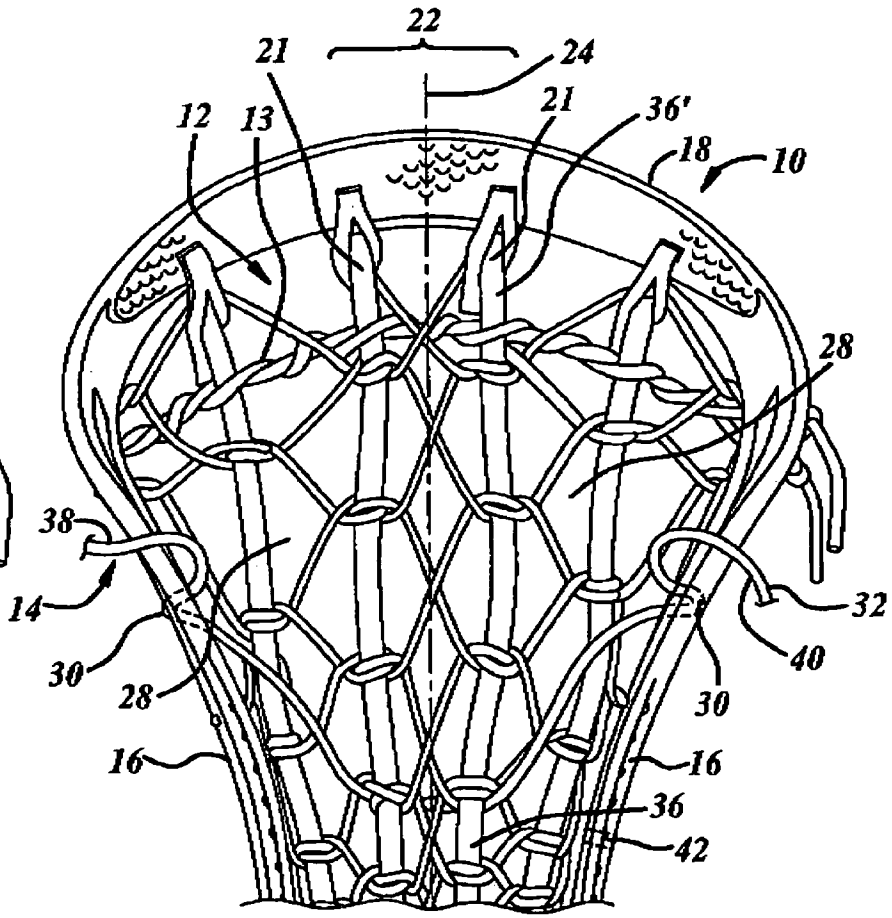
FIGS. 3A–3E are front views of a lacrosse head, illustrating the attachment of the retention structures to the netting of the lacrosse head in accordance with one embodiment of the present invention.
Figure 3A:
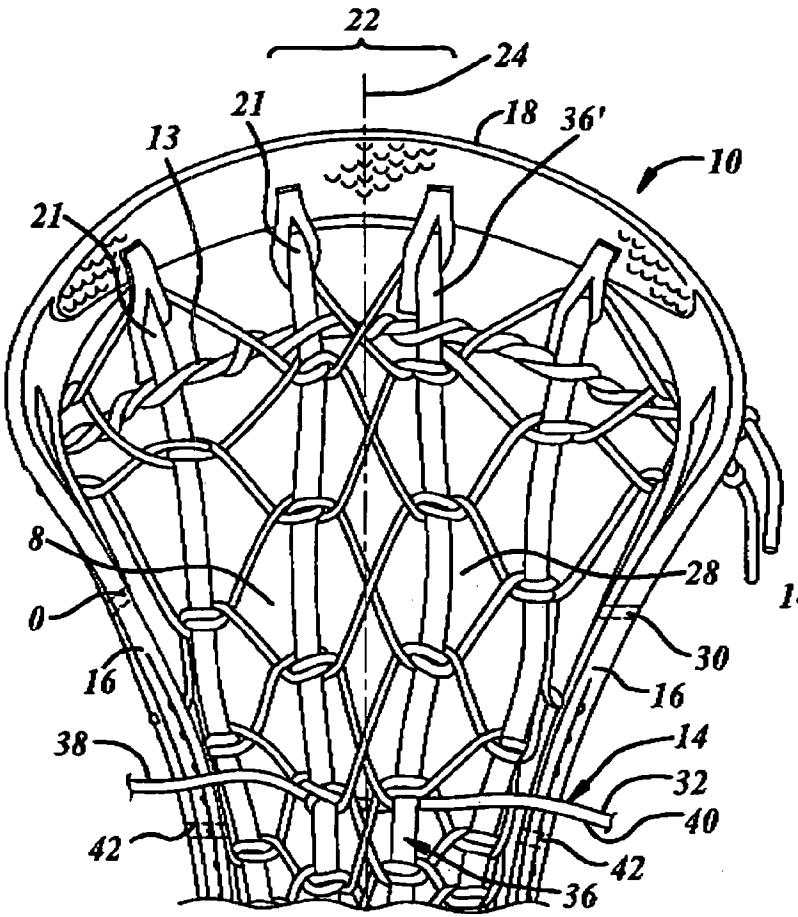

With specific reference to FIG. 3A, the lacing 32 is initially woven through a lower center portion 36 of the netting 12 such that only a minimum length of the lacing 32 is positioned on the back side of the netting 12. In other words; the majority of the length of the lacing 38 is located on the front side of the netting 12, e.g. communicable with the lacrosse ball.

As shown in FIG. 3B, the lacing 32 generally includes a first portion 38 and a second portion 40. The first portion 38 and the second portion 40 are woven through respective holes 30, 30' formed in the head 10 and preferably in the sidewalls 16 to position the first and second portions 38, 40 of the lacing on the front side of the netting 12. In fact, as shown, the first portion 38 and the second portion 40 each are woven such that they are exposed to the back side of the netting at only one location.

Figure 3D:
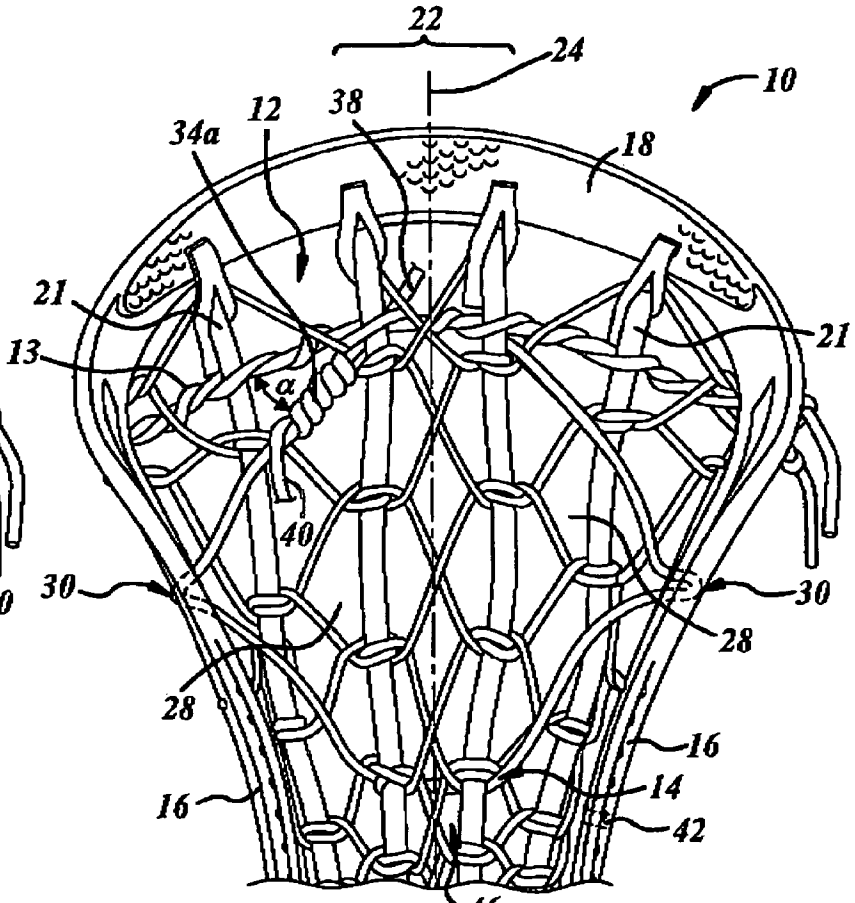
Figure 3C:
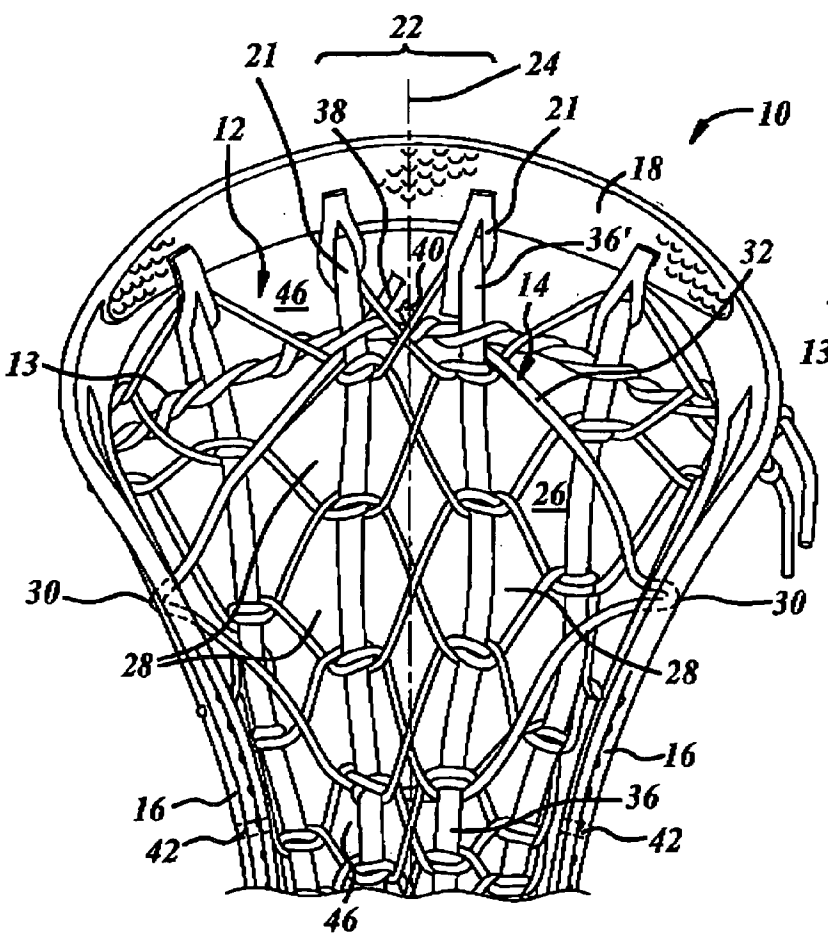

Thereafter, as shown in FIG. 3C, after the first and second portions 38, 40 are passed through the openings 30, 30', the portions are woven through an upper center portion of the netting 12 for the purpose of positioning more of the lacing 32 on the front side of the netting 12. At the upper center portion, the first and second portions 38, 40 are woven behind the netting such that the portions 38, 40 that extend from their respective opening 30, 30' are located on the front side of the netting 12.

Turning now to FIG. 3D, after the second portion 40 is passed behind the netting 12, it is then coiled around the first portion 38 of the lacing 32, as well as a portion of the netting 12. This forms a coiled segment 34*a* in the upper center portion of the stringing detent 14. This coiled segment 34*a* is intended to contact the lacrosse ball, inhibit movement of the lacrosse ball toward the scoop 18 and retain the lacrosse ball within the ball retention region 26 of the netting 12. As also shown in FIG. 3D, the coiled segment 34*a* is positioned for directing the ball away from the sidewalls 16. It will be appreciated that this feature can be beneficial for enhancing ball control and preventing the ball from bouncing against the sidewalls and out of the head 10. To that end, the coiled segment 34*a* extends from a horizontal reference line, e.g. a lateral shooting string 13 on the netting 12, by a predetermined angle α. Also, in this regard, ball retention region 26 (shown in FIG. 1) extends from lateral shooting string 13 by the predetermined angle α. Put another way, the coiled segment 34*a* extends along a predetermined length of the netting 12. Further, by coiling the first portion 38 to the netting 12, the second portion 40 is also securely coupled to the netting 12.

Figure 3E:
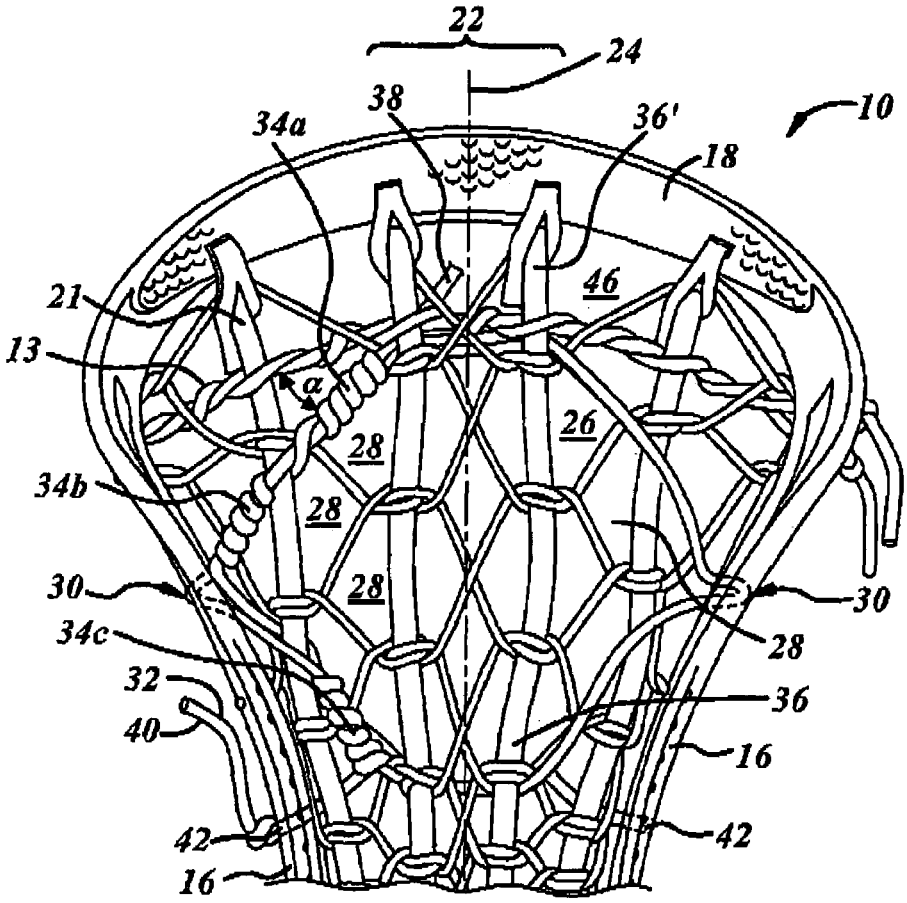

Referring to FIG. 3E, the second portion 40 of the lacing 32 is further coiled around the first portion 38 of the lacing 32 in order to form additional coiled segments 34*b* and 34*c* on the front side of the netting 12 adjacent to the lower center portion. Thereafter, the second portion 40 is woven through an aperture 42 formed in the sidewall 16 and tied in a knot that is sized larger than the aperture 42 thereby securing the stringing detent 14 to the netting 12 and the lacrosse head 10. Obviously, the end of the second portion 40 can be otherwise secured to the head.

Likewise, referring back to FIG. 1, after the first portion 38 is passed behind the netting 12, it is then coiled around the second portion 40 of the lacing 32 in order to form the a plurality of coiled segments 35*a*, 35*b*, and 35*c*. Specifically, the first portion 38 of the lacing 32 is coiled around the second portion 40 of the lacing 32, as well as a portion of the netting 12, so as to form a coiled segment 35*a* in the upper center portion of the stringing detent 14. This coiled segment 35*a* is intended to contact the lacrosse ball and retain the lacrosse ball within the ball retention region 26 of the netting 12. Further, by coiling the second portion 40 to the netting 12, the first portion 38 is also securely coupled to the netting 12. The first portion 38 of the lacing 32 is further coiled around the second portion 40 of the lacing 32 in order to form additional coiled segments 35*b* and 35*c* on the front side of the netting 12 adjacent to the lower center portion. Subsequently, the second portion 40 is woven through an aperture 42' formed in the sidewall 16 and tied in a knot for securing the stringing detent 14 to the netting 12 or otherwise secured.

Figure 5A:
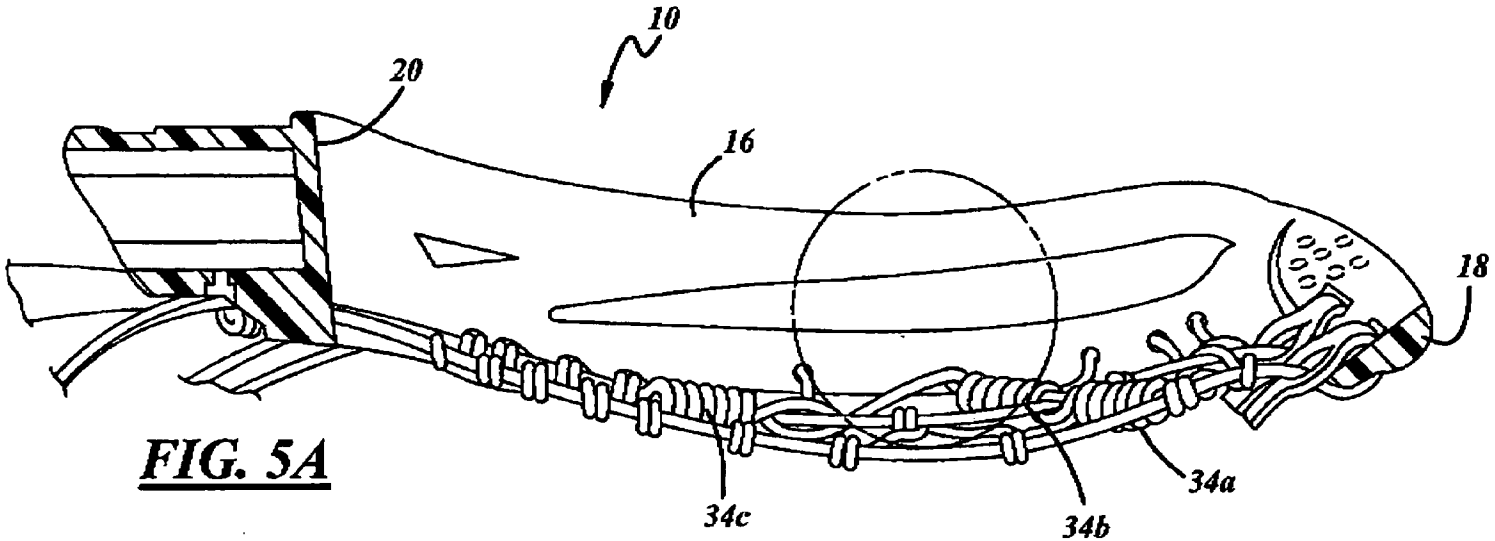
FIG. 5A is a cross-sectional view of the lacrosse head of FIG. 1, as taken along the line 5A—5A.

Referring now to FIG. 5A, the retaining structure 14 includes coiled sections 34*a*, 34*b*, 34*c*, 35*a*, 35*b* and 35*c* having surfaces located proximal to the ball retention region 26 of the netting. These surfaces are positioned substantially perpendicular to a plane defined by the netting 12. This orientation allows the surfaces of the coiled sections to engage the lacrosse ball and prevent it from rolling over the coiled sections and out of the ball retention region 26. It will be understood that the configuration of the coiled sections may vary.

Figure 4:
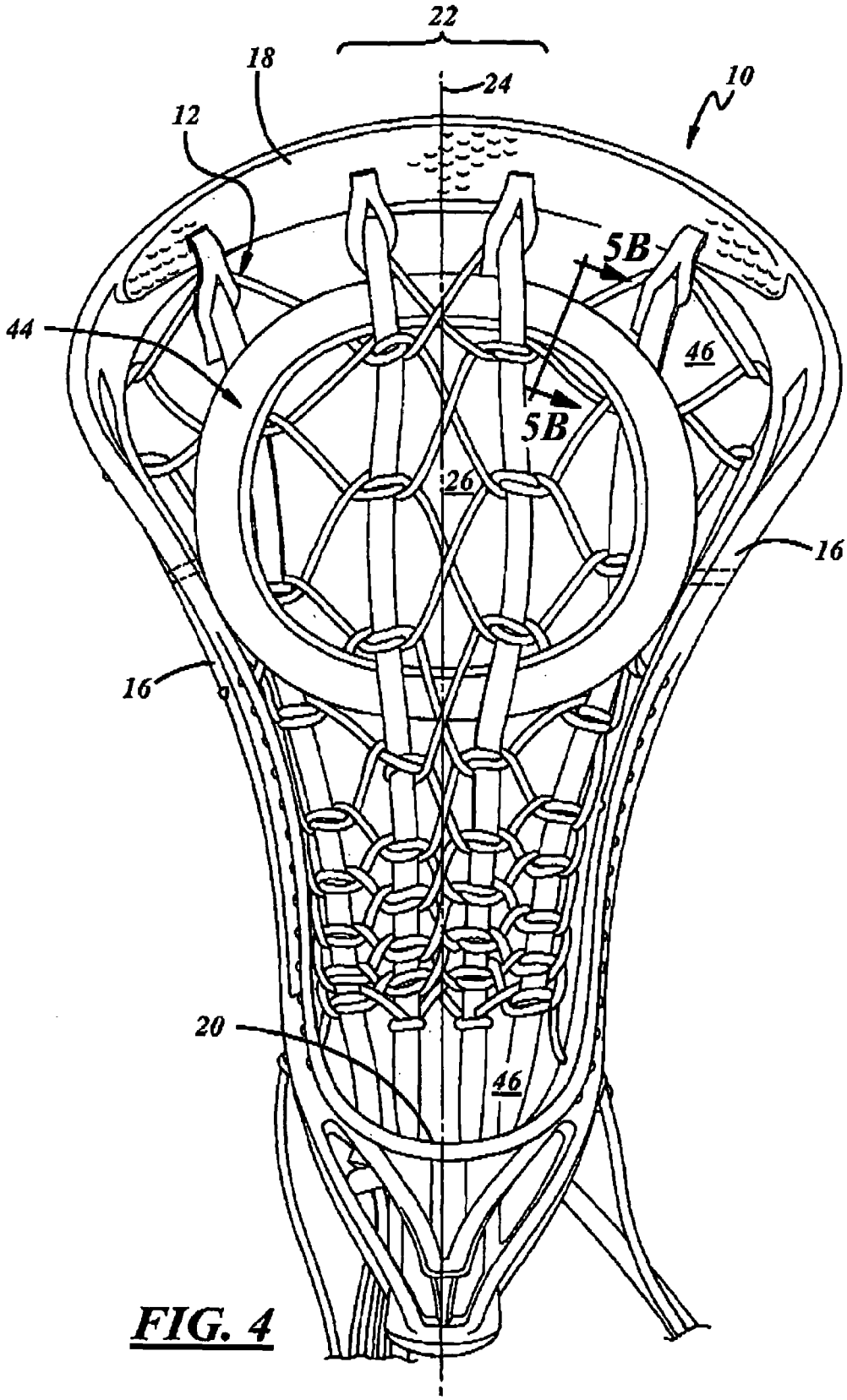
FIG. 4 is a front view of a lacrosse head having a netting with a shallow pocket and a retention structure coupled to the netting, according to another embodiment of the present invention.

Referring now to FIG. 4, there is shown a front view of a lacrosse head 10 having a netting 12 with a shallow pocket and a retention structure 44 coupled to the netting 12, according to another embodiment of the present invention. Similar to the stringing detent 14 shown in FIG. 1, the retention structure 44 defines a ball retention region 26 and one or more peripheral regions 46. The retaining structure 44 is adapted for contacting a lacrosse ball and assisting in retaining the lacrosse ball within the ball retention region 26. This feature is beneficial because it can decrease the amount of lacrosse ball movement within the lacrosse head 10 thereby improving the ball retention and the ball handling characteristics of the lacrosse head 10. For example, the retention structure 44 can prevent the lacrosse ball from rolling across the netting 12 and bouncing off one of the sidewalls 16.

Furthermore, in this embodiment, the retention structure 44 is a plastic piece that is secured to the netting. This plastic piece is preferably of a one-piece injection molded construction. However, it is understood that the retention structure 44 can be comprised of other suitable materials, can include two or more pieces, and can be constructed by various other suitable manufacturing processes as desired.

Figure 5B:
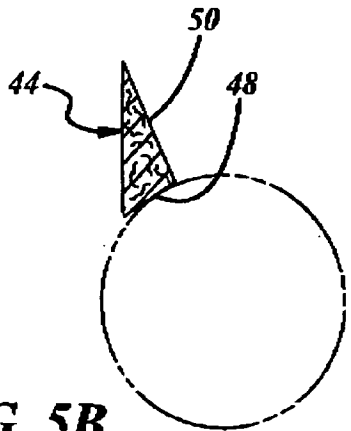
FIG. 5B is a cross-sectional view of the retention structure shown in FIG. 4, as taken along line 5B—5B.

Referring now to FIG. 5B, the retention structure 44 includes a retaining surface 48 located proximal to the ball retention region 26 of the netting 12. This retaining surface 48 is positioned substantially perpendicular to a local plane of the netting 12. This orientation allows the retaining surface 48 to engage the lacrosse ball and prevent it from rolling over the retention structure 44 and out of the ball retention region 26. Although FIG. 5B illustrates a linear section of the retaining surface 48, it is understood that the retaining surface 48 can be curved or otherwise contoured for cupping a portion of the lacrosse ball and preventing the lacrosse ball from rolling over the retention structure 44.

Furthermore, in one embodiment, the retention structure 44 includes a ramp surface 50 extending from the retaining surface 48 toward one of the peripheral regions 46. This ramp surface 50 gradually declines from the retaining surface 48 to the level of the netting 12. This structure allows the lacrosse ball to roll across the ramp surface 50 from the peripheral region 46 into the ball retention region 26.

This retention structure 44 preferably is coupled to the netting 12 by weaving the netting 12 through the retention structure 44. Of course, it is understood that the retention structure 44 can be otherwise coupled to the netting 12 by various fasteners, e.g. a series of clip fasteners or string fasteners, after the netting 12 has already been woven.

Figure 6:
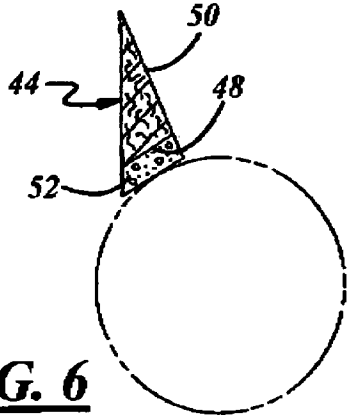
FIG. 6 is a cross-sectional view of a retention structure having an elastic deformable covering, according to yet another embodiment of the present invention.

Referring now to FIG. 6, in one embodiment, the retention structure 44 includes an elastic deformable covering 52 attached thereon for cushioning a lacrosse ball as it presses against the retaining surface 48 of the retention structure 44. In this regard, the deformable covering 52 can absorb kinetic energy of the lacrosse ball thereby preventing the lacrosse ball from bouncing off the retention structure 44. As a result, the retention structure 44 has improved ball retention and ball handling characteristics. The elastic deformable covering 52 preferably is comprised of an elastomer material that is coupled to the retaining surface 48 by an overmolding process. However, it is understood that various other materials, e.g. a foam padding or a air bladder cushion, can be utilized. Additionally, it is understood that other suitable fastening methods can be utilized and that the elastic deformable material can instead be an integral part of the retaining surface 48.

While the invention has been described in terms of preferred embodiments, it will be understood, of course, that the invention is not limited thereto since modifications may be made by those skilled in the art, particularly in light of the foregoing teachings.

What is claimed is:

1. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls;

a netting coupled to at least said scoop portion and said pair of opposing sidewalls; and at least one retention partition directing a lacrosse ball away from said pair of opposing sidewalls and enhancing ball control within the lacrosse head;

said at least one retention partition offset from a horizontal reference line by a predetermined angle for directing said lacrosse ball away from said pair of opposing sidewalls;

said at least one retention partition extending substantially across a width of said netting and substantially defining a ball retention region and at least one peripheral region of said netting;

said at least one peripheral region extending between said ball retention region and said pair of opposing sidewalls;

said at least one retention partition sufficiently extending from said netting for contacting said lacrosse ball and assisting in retaining said lacrosse ball within said ball retention region;

said at least one retention partition offset from a shooting strip portion of said netting for rolling said lacrosse ball along said shooting strip portion when throwing said lacrosse ball from said lacrosse head;

wherein said ball retention region is a center area of said netting; and has a shape selected from the group consisting of a diamond shape, a circular shape, a polygonal shape, and an elliptical shape.

2. The lacrosse head of claim 1 wherein said netting includes a shooting string extending laterally between said pair of opposing sidewalls with said at least one retention partition extending from said shooting string by said predetermined angle.

3. The lacrosse head of claim 1 wherein said netting includes a shooting string extending laterally between said pair of opposing sidewalls with said ball retention region extending from said shooting string by said predetermined angle.

4. The lacrosse head of claim 1 wherein said at least one retention partition comprises:

at least one stringing retention detent woven through said netting, said at least one stringing retention detent protruding from said netting and adapted for contacting said lacrosse ball and retaining said lacrosse ball within said ball retention region.

5. The lacrosse head of claim 4 wherein said at least one stringing retention detent is woven through at least one hole formed within said pair of opposing sidewalls.

6. The lacrosse head of claim 5 wherein said at least one stringing retention detent comprises at least one of a nylon material, a polyester material, and a cotton material.

7. The lacrosse head of claim 1 wherein said at least one peripheral region extends between said ball retention region and said scoop portion.

8. The lacrosse head of claim 1 wherein said at least one peripheral region extends between said ball retention region and said base portion.

9. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls;

a netting coupled to at least said scoop portion and said pair of opposing sidewalls; and at least one detent coil coupled to said netting for directing a lacrosse ball away from said pair of opposing sidewalk and enhancing ball control within said lacrosse head;

said at least one detent coil extending above said netting and along a predetermined length of said netting for directing said lacrosse ball away from said pair of opposing sidewalls;

said at least one detent coil substantially defining a ball retention region and at least one peripheral region of said netting;

said at least one detent coil contacting said lacrosse ball and assisting in retaining said lacrosse ball within said ball retention region;

said at least one peripheral region extending between said ball retention region and said pair of opposing sidewalls;

said netting including a shooting strip portion extending an entire length of said netting;

said at least one detent coil laterally offset from said shooting strip portion;

wherein said netting comprised a substantially shallow pocket and;

wherein said ball retention region has a shape selected from the group consisting of a diamond shape, a circular shape, a polygonal shape, and an elliptical shape.

10. The lacrosse head of claim 9 wherein said netting has a shallow pocket comprised of at least one of a traditional pocket and a mesh pocket.

11. The lacrosse head of claim 9 wherein said at least one detent coil is formed from at least one stringing retention detent woven through said netting and protruding above said netting.

12. The lacrosse head of claim 9 wherein said at least one stringing retention detent is woven through at least one hole formed within said pair of opposing sidewalls.

13. The lacrosse head of claim 9 wherein said at least one stringing retention detent extends substantially across a width of said netting so as to define a center area of said netting tapering toward said pair of opposing sidewalls.

14. The lacrosse head of claim 9 wherein said at least one stringing retention detent is formed from at least one of a nylon material, a polyester material, and a cotton material.

15. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls; and a netting coupled to said pair of opposing sidewalls and including at least one pair of stringing detent coils for enhancing ball control within said lacrosse head;

said at least one pair of stringing detent coils substantially defining a ball retention region, a shooting strip region, and at least one peripheral region of said netting;

said at least one pair of stringing detent coils assisting in retaining a lacrosse ball within said ball retention region and blocking said lacrosse ball from rolling toward said pair of opposing sidewalls;

said at least one pair of stringing detent coils extending along a predetermined length of said netting;

said shooting strip portion forming a central portion of said netting extending along an entire length of said netting;

said at least one pair of stringing detent coils offset from said shooting strip portion for quickly rolling said lacrosse bail along said shooting strip portion.

16. The lacrosse head of claim 15 wherein said at least one peripheral region extends between said ball retention region and at least one of said scoop portion, said base portion, and said pair of opposing sidewalls.

* * * * *